United States Patent [19]

Nonnenmacher

[11] Patent Number: 4,496,290

[45] Date of Patent: Jan. 29, 1985

[54] CONTROL DEVICE FOR MAINTAINING THE PRODUCT OF THE LIFTING PRESSURE AND LIFTING VOLUME TIMES FLOW CONSTANT IN AN ADJUSTABLE PUMP

[75] Inventor: Gerhard Nonnenmacher, Korntal, Fed. Rep. of Germany

[73] Assignee: Robert Bosch GmbH, Stuttgart, Fed. Rep. of Germany

[21] Appl. No.: 424,960

[22] Filed: Sep. 27, 1982

[30] Foreign Application Priority Data

Jan. 14, 1982 [DE] Fed. Rep. of Germany ..... 3200867
Mar. 5, 1982 [DE] Fed. Rep. of Germany ..... 3207961

[51] Int. Cl.[3] ..... F04B 49/00
[52] U.S. Cl. ..... 417/220
[58] Field of Search ..... 417/218-222; 60/445-452

[56] References Cited

U.S. PATENT DOCUMENTS 4,081,223 3/1978 Fricke et al. ..... 417/218
4,273,517 6/1981 Heyl ..... 417/222
4,370,100 1/1983 Forster et al. ..... 417/218

FOREIGN PATENT DOCUMENTS 2,362,093 6/1975 Fed. Rep. of Germany ..... 417/220
2942403 4/1981 Fed. Rep. of Germany ..... 417/218

*Primary Examiner*—Edward K. Look
*Attorney, Agent, or Firm*—Michael J. Striker

[57] ABSTRACT

A control system for maintaining the product of the lifting pressure and lifting volume times flow constant in an adjustable pump having a regulating member acted upon by two pressure-controlled pistons. The device includes a control valve which is operatively connected with a spring with a linear characteristic, which spring is through the control valve operatively connected to an adjusting lever having an arm which is varied proportionally to the working pressure of the pump. The moment is produced by the force of that spring and that variable lever arm. A counter moment is generated by a force of a second spring and a second arm of the adjusting lever. Upon creating the force equilibrium on the adjusting lever the control valve is so controlled that the product of the pumping pressure and pumping volume times flow remains constant. The control valve controls one of the two pressure-controlled pistons which adjusts the stroke of the regulating member.

15 Claims, 11 Drawing Figures

CONTROL DEVICE FOR MAINTAINING THE PRODUCT OF THE LIFTING PRESSURE AND LIFTING VOLUME TIMES FLOW CONSTANT IN AN ADJUSTABLE PUMP

BACKGROUND OF THE INVENTION

The present invention relates to adjustable pumps in general. More particularly, this invention relates to control devices for adjustable pumps, where it is desired that the product of the lifting pressure and lifting volume times flow be kept constant, independent of the driving speed of the pump.

Regulating systems for maintaining the delivered hydraulic power constant are known in the art. The disadvantage of these otherwise satisfactory systems is that their application possibilities are limited in that an adjusting process is required for each type of the pump and for each desired product of the lifting pressure and lifting volume, this causing undesired expenses. Furthermore, the application of such conventional regulating systems for the pumps with a small adjustment path is not often possible.

SUMMARY OF THE INVENTION

It is therefore an object of the invention to provide a control system which causes the delivered output of an adjustable pump to remain constant and is sufficiently flexible so as to be applicable for the pumps of various sizes and types.

It is a further object of the invention to provide an improved control system of the type under consideration which is suitable even for pumps having a small adjustment path.

These and other objects of the invention are attained by a control device for maintaining the product of the pumping pressure and pumping volume times flow constant in a pumping system of the type including an adjustable pump furnishing a pumping pressure and a pumping volume at an output side and having a regulating element for adjusting said volume, and a first and second pressure-controlled pistons for adjusting the regulating element, the control device comprising control valve means adapted to control the pressure on said second piston; an adjusting lever operatively connected to said control valve means; means for producing a first force acting on said adjusting lever and including a first spring with approximately linear characteristic, the first spring acting upon said second piston and being operatively connected to said valve control means, said first spring having a prestressing corresponding to a linear proportional path of the pumping volume of the pump; and means for producing a second force acting on said adjusting lever. The adjusting lever has an arm, the length of said arm being proportionally varied in accordance with a working pressure of the pump, the arm being operatively connected to the valve control means, whereby in the case of an unbalance between said first force and said second force said control valve means is actuated and controls the regulating member of the pump via said second piston until the pumping volume of the pump is corrected and a balance between said first force and said second force is reached to maintain said valve control means in equilibrium position and thus maintain the product of the product of the pumping pressure and pumping volume times flow constant.

Means for producing a second force in counteraction to the first force can be a second compression spring or a coil spring.

The device may further include a cylinder and a piston slidably mounted therein, said piston being loaded by the lifting pressure of the pump, said piston being connected to said arm of the adjusting member and adapted to vary its length in accordance with the working pressure in the cylinder.

In accordance with further features of the invention the adjusting lever may have a second arm connected to the second spring, said piston varying a position of a pivot point between said first mentioned arm and said second arm and thus the length of said first mentioned arm.

The piston may have a roller operated to vary the position of said pivot point.

In accordance with a further modification of the device means for varying the second force may be provided, including an additional pivotable two-arm lever and a setting screw, said second spring being supported on one arm of said additional lever, said setting screw being adapted to act upon a second arm of the additional lever and in the region of action of the first force.

The device may include a third spring for producing a third force and arranged between the control valve means and the second arm of said additional lever, said third spring acting along a line of said first force but in an opposite direction thereto.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
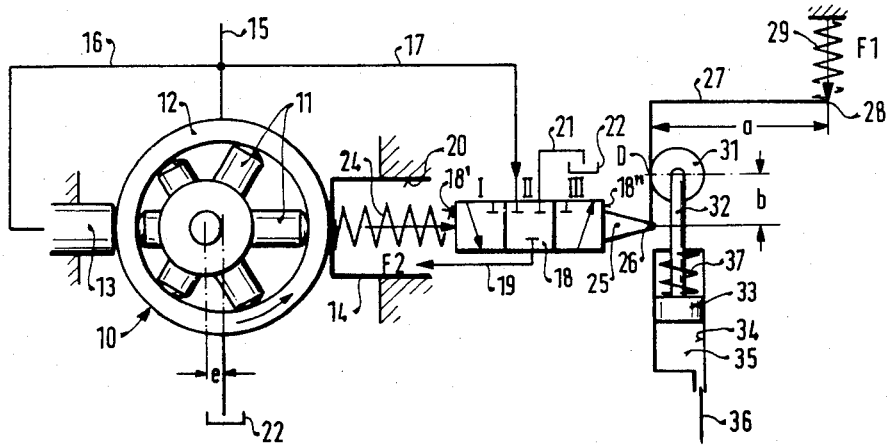
FIG. 1 is a schematic diagram showing a control device of the present invention in accordance with a first embodiment.

Referring now to the drawings, and first to FIG. 1, this figure shows an adjustable pump 10, for example radial piston pump, having a regulating member 12 which regulates the stroke of the pump. Regulating member 12 operates under control of a first pressure-loaded adjusting piston 13 and a second pressure-loaded adjusting piston 14. Piston 13 has a smaller diameter that piston 14. Piston 13 is continuously loaded by a prevailing pressure of a pressure medium in a supply conduit 15 through a conduit 16.

A conduit 17 branches out from the supply conduit 15. Conduit 17 leads to a three-position three-port control valve 18 with respective control or switch positions I, II and III. A conduit 19 leads from the control valve 18 to a receiving bore 20 of the adjusting piston 14. Conduit 21 leads from the control valve 18 to a container 22 from which pump 10 lifts the pressure medium, e.g. liquid.

A compression spring 24 is mounted in the adjusting piston 14; one end of that spring bears against the bottom of the adjusting piston 14 whereas the other end of the spring 24 continuously acts upon a face 18' of the control valve 18. The opposite face 18'' of the control valve is pivotally connected by an extention 25 at its end 26, to one end of an angular two-arm lever 27. The second end 28 of the angular lever 27, and particularly the end of its longer arm, is continuously acted upon by a spring 29. It is essential that the spring 24 acting upon the control valve 18 has a large linear characteristic.

The device according to the invention further includes a pressure-loaded cylinder 34 in which piston 33 with its rod 32 is slidably guided. Piston rod 32 terminates with a roller 31 against which a pivot point D of lever 27 bears. A pressure chamber 35 of the cylinder 34 is continuously loaded with a lifting pressure of pump 10 through a conduit 36 which is in communication with supply conduit 15. A compression spring 37 provided on the piston 33 acts against the liquid force. It is important that spring 37 has a large linear characteristic.

Lever 27 forms two lever arms a and b separated by the pivot point D. The force of the spring 29 is denoted by F1 and is a second force whereas the force of spring 24 is designated by F2 and is a first force.

The control valve 18 is in its neutral position II when the force balance at lever 27 prevails. When now the lifting pressure increases piston 33 is moved against the force of spring 37 which causes the increase of the lever arm b. Thereby the moment produced by the spring force F2 and the lever arm b will be greater than the continuously generated moment produced by spring force F1 and the lever arm a so that the spring 24 can deviate and the control valve 18 will be moved to its control position I. The pressure medium can now enter the bore 20 of piston 14 through conduits 17, 19 and the adjusting piston 14 will be moved to the left whereupon the regulating member 12 will cause the pump to be adjusted to smaller liquid quantities. This will result in that due to the movement of piston 14 to the left, the spring 24 will slacken. Meanwhile the moment produced by spring force F1 and the lever arm a is outbalanced so that lever 27 will pivot in the clockwise direction and the control valve 18 will again be moved to its neutral position. Thereby a new equilibrium position of the valve 18 will be set up.

If now the lifting pressure of the pump moves the spring 37 of piston 33 in the downward direction the lever arm b will become smaller. Thus the torque produced by the spring force F1 and the lever arm a will be outbalanced so that the control valve 18 will be moved to its control position III. The pressure liquid can now flow from bore 20 into container 22 and the adjusting piston 13 continuously acted upon by the lifting pressure will adjust the pump to greater liquid quantities. By moving adjusting piston 14 in the direction toward control valve 18 the spring 24 will be tensioned and the control valve 18 will be moved again to its neutral position.

The load-and-torque-regulator according to the invention transforms at least approximately a proportional path of the adjusting piston 14 acted upon by lifting volumes of the pump into a spring force via the spring 24 with somewhat linear characteristic. The length of the lever arm b, to which the force of spring 24 is applied, varies proportionally to the working pressure of the pump. An exact hyperbolic characterisitc curve is thus maintained in the above described working fashion over lifting pressures and liquid quantities.

Figure 2:
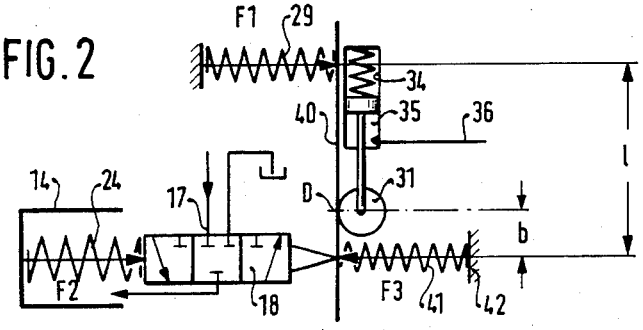
FIG. 2 is a schematic diagram of the second embodiment of the device.

With reference to FIG. 2 it will be seen that the pump 10 and all the supply and discharge conduits connected therewith as shown in FIG. 1 are omitted herein since they are similar to those of FIG. 1. Similar reference characters will be used in FIG. 2 to identify the elements similar to those in FIG. 1. In this embodiment a double-acting lever 40 extends between the aforementioned end 26 of extension 25 of valve 18 and the end of spring 29 which generates force F1. The distinction between the embodiment of FIG. 2 and that of FIG. 1 is that an additional spring 41 is provided producing force F3 acting along the same line as spring 24 but against the force of spring 24. Spring 41 is supported at a support 42 rigidly connected to a housing of the device. It can be recognized that no transversal forces act upon the control valve 18 and cylinder 34 whereby the adjustability due to force fluctuations is improved. The mode of operation of the control device illustrated in FIG. 2 is exactly the same as that described for FIG. 1.

Figure 3:
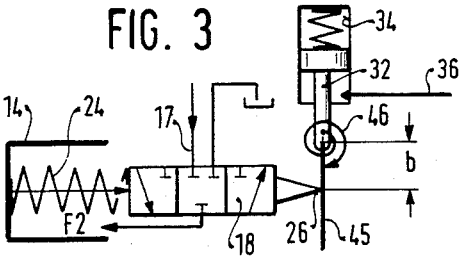
FIG. 3 is a schematic diagram of the third embodiment of the control device.

In the embodiment shown in FIG. 3 the construction of the control device is substantially the same as those disclosed for FIGS. 1 and 2. The principle of operation is also similar. Here the lever for force-equilizing is an one-arm lever 45 which is pivotally connected to the piston rod 32 of piston 33 movable in cylinder 34. A coil spring 46 is connected to the piston rod 32 at its one end, and at its other end spring 46 acts upon lever 45. Coil spring 46 functions in the same manner as spring 29 in the control device shown in FIGS. 1 and 2. In other words, coil spring 46 produces a torque counter to the torque generated by the force of spring 24 and the lever arm b. The mode of operation of this embodiment is in principle the same as the above described modes of the systems depicted in FIGS. 1 and 2.

Figure 4:
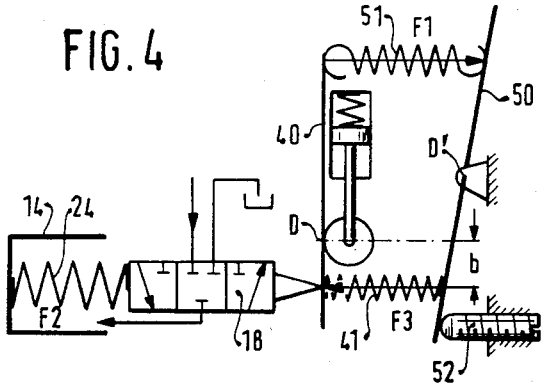
FIG. 4 is a schematic diagram of the fourth embodiment of the invention.

The structure shown in FIG. 4 basically corresponds to that of FIG. 2. However, in this construction it is possible to adjust the system to a desired torque and desired capacity. This can be obtained by means of a second two-arm lever 50 which extends somewhat parallel to lever 40 described for FIG. 2. Lever 50 is pivotally supported on a pivot D'. A spring 51 corresponding to spring 29 of FIG. 2 engages with its one end the pivotal lever 50 and with its opposite end the upper end of lever 40. The device is further provided with a setting screw 52 adapted to act upon the lever 50 at the lower end thereof and in the direction opposite to that of force F3 of spring 41. Setting screw 50 is adapted to vary the angle of inclination of lever 50 and thereby the tension of springs 24 and 41. As setting screw 52 is rotated the operating force on the control valve 18 is varied thus causing the change in the capacity or the torque hyperbolic curve of lifting pressure-fluid flow.

Figure 5:
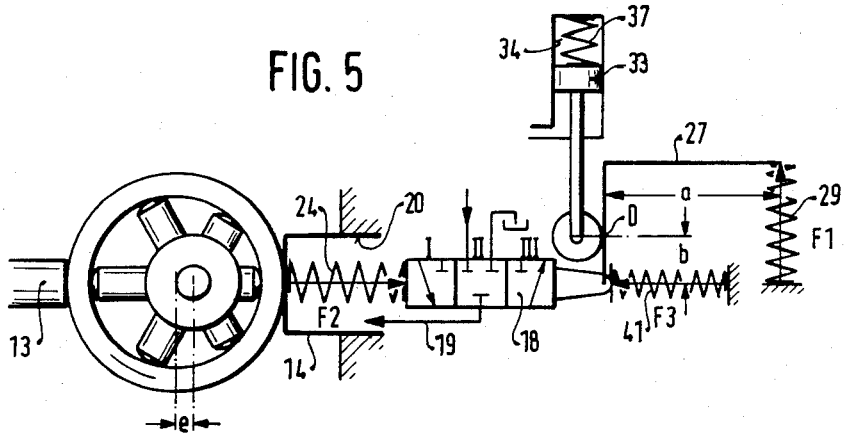
FIG. 5 is a schematic diagram of the further modification of the invention.
Figure 6:
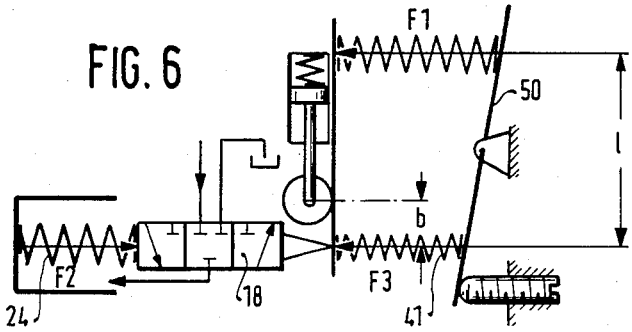
FIG. 6 is a schematic diagram of yet another embodiment of the control device.
Figure 7:
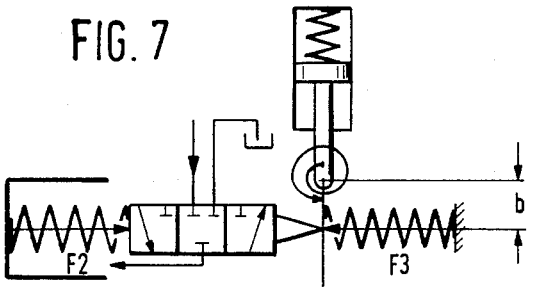
FIG. 7 is a schematic diagram of the further embodiment of the invention.

FIGS. 5–7 show still another embodiments of the invention which are distinguished from the above described constructions in that if in the structures of FIGS. 1–4 the pump is set back to smaller fluid quantities through the loading of the adjusting piston 14 (see also FIG. 8), in the embodiments shown in FIGS. 5–7 this mode is reversed. Here, the pump is adjusted to greater lifting fluid quantities through the loading of adjusting piston 14. For this purpose, only a simple modification of the construction is suggested, namely the spring 29 (FIG. 5) producing force F1 acts upon lever 27 in the direction opposite to that of FIG. 1. The eccentricity "e" of the regulating member 12 lies in the direction opposite to that of FIGS. 1–4.

If a balance on lever 27 in the embodiment of FIG. 5 prevails and lifting pressure increases piston 33 in cylinder 34 will be moved upwardly so as to enlarge the length of lever arm b. Thus the torque produced by the difference of forces of springs 24 and 41 and the lever arm b will be increased. The counter moment generated by the force of spring 29 and the lever arm a will be overcome and the control valve 18 will be brought to its control or switch position III. This will allow the pressure medium to flow from the bore 20 to the container 22. Adjusting piston 13 continuously loaded by lifting pressure adjusts the pump to smaller liquid quantities. If now the pressure drops piston 33 will be moved by spring 37 in the downward direction and the lever arm b will be smaller. The torque produced by the force F1 of spring 29 and the lever arm a will increase and the control valve 18 will be moved to its neutral position.

If the pressure drops in the supply conduit the piston 33 will move the pivot point D in the downward direction so as to reduce the length of the lever arm b; this will outbalance the torque produced by the force F1 of spring 29 and the lever arm a. Now the control valve 18 will be brought to the switch or control position I and the pressure medium will be allowed to enter from the supply conduit through conduit 19 into the bore 20 of piston 14 and the pump will be adjusted to greater fluid quantities. This will be lasting until the equilibrium position of control valve 18 is achieved again.

The embodiment of FIG. 6 corresponds to the structure of FIG. 4. The control system shown in FIG. 7 corresponds to the construction of FIG. 3. The modes of operations of the constructions of FIGS. 6 and 7 are substantially the same as those for the above-described FIGS. 4 and 3. Therefore, the detailed discussion of the embodiments of FIGS. 6 and 7 appears to be superfluous.

With regard to the springs it should be noted that in the case of the even spring range of springs 51 and 41 in the embodiments of FIGS. 4 and 6 the adjusting lever should be positioned centrally, otherwise the pivot would be displaced from the central line such a great distance that the lever arms of the springs would be inversely proportional to their spring ranges.

Figure 8:
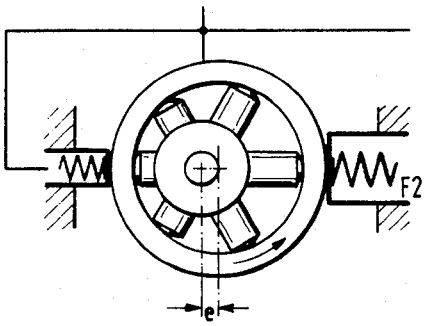
FIGS. 8 and 9 are schematic diagrams of the regulating members with different eccentricities.
Figure 9:
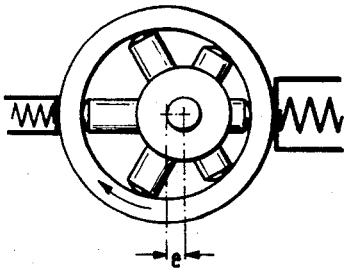

FIGS. 8 and 9 schematically show two embodiments of the regulating member 12 with different eccentricities. The eccentricity of the regulating member of FIG. 8 is similar to that shown in FIG. 1 whereas in FIG. 9 eccentricity "e" of the regulating member is directed oppositely to that of FIG. 8.

Figure 10:
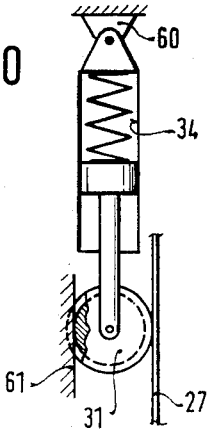
FIG. 10 illustrates a schematic diagram of still another embodiment of the invention.
Figure 11:
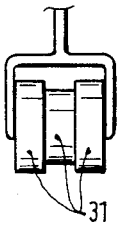
FIG. 11 is a side view of the roller formed of three independent rollers in accordance with still further embodiment of the invention.

In the embodiment of FIGS. 10 and 11 cylinder 34 is formed as a pressure measuring member which is free of transversal forces. For this purpose cylinder 34 is pivotally supported to the housing at a support 60. The reaction force of lever 27 will be applied, preferably uniformly in the axial direction to roller 31 of a uniform or changeable diameter, which roller is supported on a housing portion 61. Advantageously, roller 31 can be formed of three rollers adapted to rotate independently one from another as can be seen from FIG. 11 which shows a partial side view of FIG. 10 if roller 31 were replaced by three rollers.

It will be understood that each of the elements described above, or two or more together, may also find a useful application in other types of control devices differing from the described above.

While the invention has been illustrated and described as embodied in a control device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A control device for maintaining the product of the pumping pressure and pumping volume times flow constant in a pumping system of the type including an adjustable pump furnishing a pumping pressure and a pumping volume at an output side and having a regulating element for adjusting said volume, and a first and second pressure-controlled pistons for adjusting the regulating element, the control device comprising control valve means adapted to control the pressure on said second piston; an adjusting lever operatively connected to said control valve means; means for producing a first force acting on said adjusting lever and including a first spring with approximately linear characteristic, said first spring acting upon said second piston and being operatively connected to said valve control means, said first spring having a prestressing corresponding to a linear proportional path of the pumping volume of the pump; means for producing a second force acting on said adjusting lever, said adjusting lever having at least one arm operatively connected to said valve control means; and means for varying the length of said arm proportionally in accordance with a working pressure of the pump and including a cylinder and a piston slidably positioned therein, said piston in said cylinder being loaded by a pumping pressure of the pump and being connected to said arm and being adapted to vary the length of said arm in accordance with the pressure in said cylinder, whereby in the case of unbalance between said first force and said second force said control valve means is actuated by said arm so as to control the regulating member of the pump via said second piston until the pumping volume of the pump is corrected and a balance between said first force and said second force is reached to maintain said valve control means in equilibrium position.

2. The device as defined in claim 1, wherein said adjusting lever is a double-acting lever.

3. The device as defined in claim 2, wherein said means for producing a second force is a second spring.

4. The device as defined in claim 3, said adjusting lever having a second arm connected to said second spring, said piston varying a position of a pivot point between said first mentioned arm and said second arm and thus the length of said first mentioned arm.

5. The device as defined in claim 4, said piston having a piston rod terminated with a roller operated to vary the position of said pivot point.

6. The device as defined in claim 5, wherein said piston is loaded with a spring acting against the pumping pressure.

7. The device as defined in claim 6, wherein said adjusting lever is straight, said first force and said second force being applied to respective ends of said arms.

8. The device as defined in claim 6, wherein said adjusting lever is angular, said first force and said second force being applied to respective ends of said arms.

9. The device as defined in claim 8, wherein the second arm of said adjusting lever, to which said second force is applied, is constant.

10. The device as defined in claim 6, further including means for varying said second force.

11. The device as defined in claim 10, wherein said means for varying said second force including an additional pivotable two-arm lever and a setting screw, said second spring being supported on one arm of said additional lever, said setting screw being adapted to act upon a second arm of said additional lever and in the region of action of said first force.

12. The device as defined in claim 11, including a third spring for producing a third force and arranged between said control valve means and the second arm of said additional lever, said third spring acting along a line of said first force but in an opposite direction thereto.

13. The device as defined in claim 5, wherein said first spring is supported at its one side on said second piston and at its other side on said control valve means, said control valve means acting directly upon said adjusting lever.

14. The device as defined in claim 1, wherein said second spring is a coil spring pivotally supported on said piston.

15. The device as defined in claim 1, wherein said control valve means is a three-position three-port valve.

* * * * *